US011346190B2

(12) United States Patent
Rogers et al.

(10) Patent No.: US 11,346,190 B2
(45) Date of Patent: May 31, 2022

(54) REMOTELY-ACTIVATED LINER HANGER AND RUNNING TOOL

(71) Applicants: Ryan Rogers, Houston, TX (US); Charles Meador, Cypress, TX (US); Keven O'Connor, Houston, TX (US); Steve Cortez, Katy, TX (US)

(72) Inventors: Ryan Rogers, Houston, TX (US); Charles Meador, Cypress, TX (US); Keven O'Connor, Houston, TX (US); Steve Cortez, Katy, TX (US)

(73) Assignee: BAKER HUGHES OILFIELD OPERATIONS LLC, Houston, TX (US)

( * ) Notice: Subject to any disclaimer, the term of this patent is extended or adjusted under 35 U.S.C. 154(b) by 87 days.

(21) Appl. No.: 16/822,799

(22) Filed: Mar. 18, 2020

(65) Prior Publication Data

US 2021/0293119 A1 Sep. 23, 2021

(51) Int. Cl.

| | |
|---|---|
| ***E21B 43/10*** | (2006.01) |
| ***E21B 47/16*** | (2006.01) |
| ***E21B 47/09*** | (2012.01) |

(52) U.S. Cl.

CPC ..... *E21B 43/108* (2013.01); *E21B 47/09* (2013.01); *E21B 47/16* (2013.01)

(58) Field of Classification Search

CPC ..... E21B 23/01; E21B 23/0416; E21B 23/08; E21B 47/14; E21B 47/16; E21B 47/18

See application file for complete search history.

(56) References Cited

U.S. PATENT DOCUMENTS

| | | | | |
|---|---|---|---|---|
| 7,928,861 | B2 | 4/2011 | Camwell et al. | |
| 8,115,651 | B2 | 2/2012 | Camwell et al. | |
| 8,823,543 | B2 | 9/2014 | Camwell et al. | |
| 9,458,711 | B2 | 10/2016 | Van Zelm | |
| 9,797,241 | B2 | 10/2017 | Mcrory | |
| 10,060,255 | B2 | 8/2018 | Van Zelm | |
| 10,103,846 | B2 | 10/2018 | Van Zelm et al. | |
| 2013/0180715 | A1* | 7/2013 | Harris | E21B 43/105 166/285 |
| 2017/0022772 | A1* | 1/2017 | Tolley | E21B 47/01 |
| 2018/0112481 | A1* | 4/2018 | Gordon | E21B 47/01 |
| 2018/0363457 | A1 | 12/2018 | Van Zelm | |
| 2019/0052410 | A1 | 2/2019 | Van Zelm et al. | |
| 2019/0383108 | A1* | 12/2019 | Massey | E21B 47/092 |
| 2020/0157935 | A1* | 5/2020 | Patterson | E21B 47/095 |
| 2021/0222522 | A1* | 7/2021 | Greci | E21B 47/01 |

* cited by examiner

*Primary Examiner* — Abby J Flynn
*Assistant Examiner* — Yanick A Akaragwe
(74) *Attorney, Agent, or Firm* — Cantor Colburn LLP

(57) ABSTRACT

A downhole tool for applying a force to a component in a borehole penetrating a subsurface formation includes an acoustic transducer configured to receive an acoustic signal. The tool also includes a spring having a spring force, a spring force retention device defining a perimeter having a gap and in mechanical communication with the component where the spring force retention device being configured to retain the spring force, and a gap member configured to be disposed in the gap. The tool further includes a force generator coupled to the gap member and in operable communication with the acoustic receiver and configured to operate in response to receiving the acoustic signal to withdraw the gap member from the gap to cause the spring force retention device to release the spring force thereby applying the spring force to the component.

20 Claims, 9 Drawing Sheets

Section A–A

Section A–A

REMOTELY-ACTIVATED LINER HANGER AND RUNNING TOOL

BACKGROUND

Boreholes or wellbores drilled into earth formations for the extraction of hydrocarbons are typically lined with a casing. Liners such as tubing may have to be installed in the wellbores as part of the extraction process. A liner secured to a liner hanger is lowered into the wellbore by a running tool connected to a work string. At a selected location, the liner hanger is activated to grip the casing and thus secure the liner in place. Once the liner hanger is activated, the running tool releases the liner hanger and the running tool is returned to the surface. One way to activate a liner hanger requires a ball to drop and seal an opening in the liner hanger. Unfortunately, this can disrupt a flow of wellbore conditioning fluids while the hanger is being set. Hence, it would be well received in the hydrocarbon production industry if apparatuses and methods were developed to improve the installation of liner hangers.

BRIEF SUMMARY

Disclosed is a downhole tool for applying a force to a component in a borehole penetrating a subsurface formation. The downhole tool includes: an acoustic transducer configured to receive an acoustic signal; a spring having a spring force; a spring force retention device defining a perimeter having a gap and in mechanical communication with the component, the spring force retention device being configured to retain the spring force; a gap member configured to be disposed in the gap; and a force generator coupled to the gap member and in operable communication with the acoustic receiver and configured to operate in response to receiving the acoustic signal to withdraw the gap member from the gap to cause the spring force retention device to release the spring force thereby applying the spring force to the component.

Also disclosed is a method for applying a force to a component in a downhole tool disposed in a borehole penetrating a subsurface formation. The method includes: receiving an acoustic signal through a work string to the downhole tool; retaining a spring force of a spring disposed on the downhole tool using a spring force retention device defining a perimeter having a gap with a gap member disposed in the gap, the spring being in mechanical communication with the component; and withdrawing the gap member from the gap upon receiving the acoustic signal causing the spring force retention device to release the spring force and apply the spring force to the component.

BRIEF DESCRIPTION OF THE DRAWINGS

The following descriptions should not be considered limiting in any way. With reference to the accompanying drawings, like elements are numbered alike.

DETAILED DESCRIPTION

A detailed description of one or more embodiments of the disclosed apparatus and method presented herein by way of exemplification and not limitation with reference to the figures.

Disclosed are embodiments of apparatuses and methods for installing a liner hanger in a borehole penetrating the earth. The apparatuses include a remotely-activated liner hanger and a remotely-activated running tool. The liner hanger and the running tool are activated by an acoustic signal that travels from a surface acoustic transmitter, along a work string conveying the running tool, and to an acoustic receiver on the hanger and on the tool. Optionally, an acoustic signal may be transmitted to the surface from the hanger and from the tool confirming operation of the hanger and tool.

Figure 1:
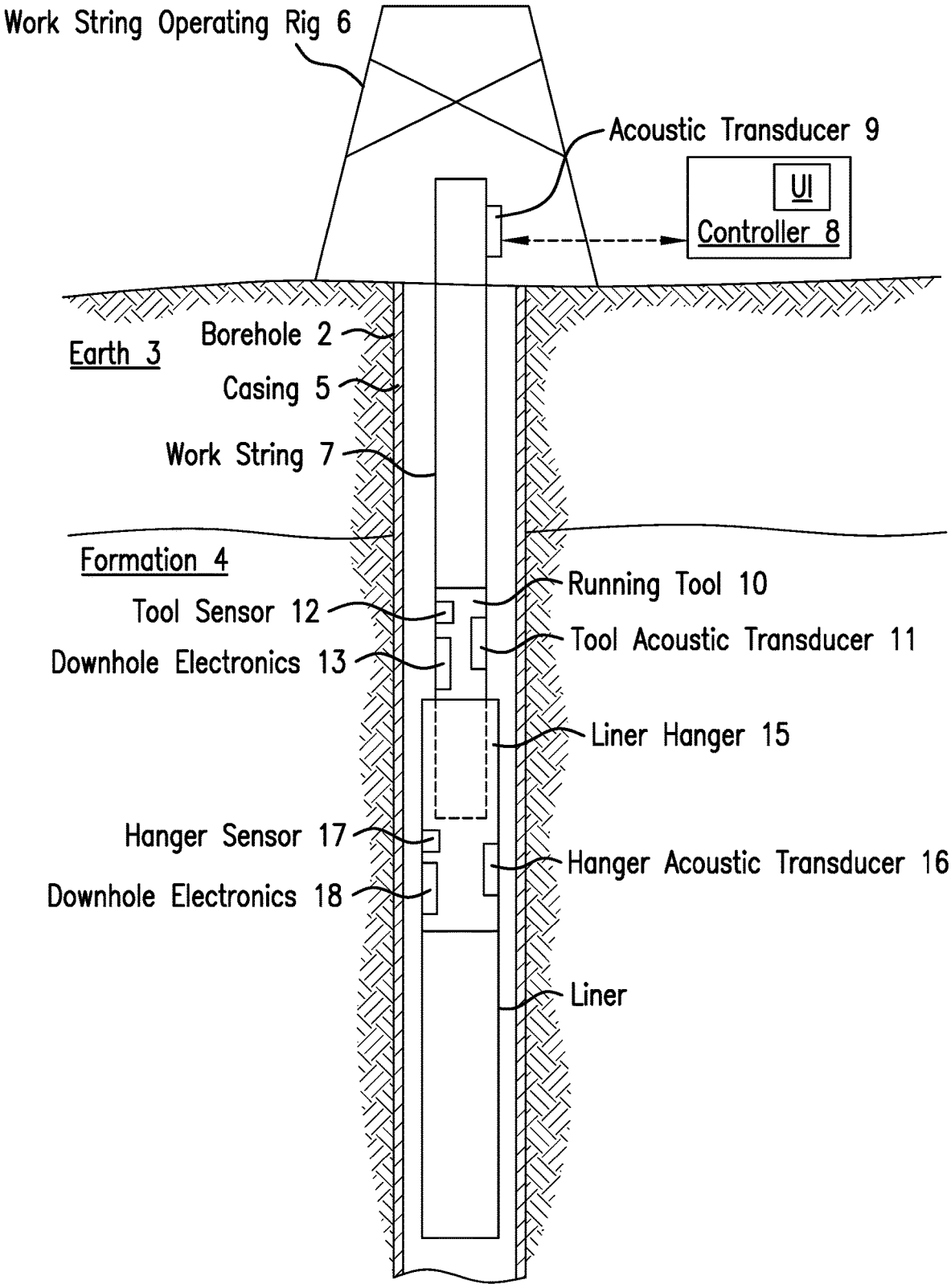
FIG. 1 is a cross-sectional view of an embodiment of a liner hanger conveyed by a running tool in a borehole penetrating the earth.

FIG. 1 illustrates a cross-sectional view of a borehole 2 penetrating a subsurface formation 4, which contains a reservoir of hydrocarbons. The borehole 2 is lined with a casing 5. A work string operating rig 6 is configured to operate a work string 7, which in one or more embodiments is a string of coupled metal pipes. In one or more embodiments, operating the work string 7 includes raising, lowering, and/or rotating the work string 7 in addition to pumping a fluid through the work string 7. A controller 8 is disposed at the surface and is configured to operate an acoustic transmitter or transducer 9 for transmitting an acoustic signal downhole through the work string or any downhole tubular using the work string, casing, or other tubular as a telemetry medium. The controller 8 may include a user interface such as a switch for transmitting an activation command. In one or more embodiments, the acoustic transducer 9 is configured to convert an electrical signal into an acoustic signal and, conversely, convert an acoustic signal into an electric signal. Hence, the acoustic transducer 9 may act as an acoustic transceiver for both transmitting and receiving acoustic signals. If receiving an acoustic signal, the controller 8 may include a user interface (UI) such as a display for displaying information obtained from the received acoustic signal. While not shown, the work string 7 may include acoustic repeaters for relaying acoustic signals down the work string 7 and, optionally, up the work string 7 to the surface especially when the work string 7 is so long that acoustic signals will lose strength and deteriorate over the length of work string.

A running tool 10 is conveyed in the borehole 2 by the work string 7. The running tool 10 is releasably connected to a liner hanger 15 and is configured to convey the liner hanger 15 to a selected location for it to be secured in the borehole 2. The liner hanger 15 supports a liner 19. The running tool 10 includes a tool acoustic transducer 11 configured to receive an acoustic activation signal from the surface acoustic transmitter 9 via the work string 7 for tool activation. Similarly, the liner hanger 15 includes a hanger acoustic transducer 16 configured to receive an acoustic activation signal from the surface acoustic transducer 9 via the work string 7 for hanger activation. In one or more embodiments, the acoustic transducer 11 and/or 16 may also be used to transmit an acoustic signal to the surface via the work string 7. In one or more embodiments, the running tool 10 is in a series of tools referred to as an inner string that is disposed in an outer string that includes the liner hanger 15.

A tool sensor 12 may be used to sense an operational aspect of the tool 10 where the sensed data is sent to the controller 8 as an acoustic signal. Similarly, a liner hanger sensor 17 may be used to sense an operational aspect of the liner hanger 15 where the sensed data is sent to the controller 8 as an acoustic signal. In one or more embodiments, the sensor 12 and/or 17 is a position sensor configured to sense a position of a component so that a user at the surface can know the position or status of a component before and after activation and can thus confirm proper operation of the component. Non-limiting embodiments of the position switch include a reed switch that closes when in close proximity to a magnet disposed on a moveable component and a switch that actuates when in contact with a moveable component. Other types of position switches or sensors may also be used. The sensor 12 and/or 17 may also be configured to sense other properties such as health of associated systems or components, a position or location in the borehole where the liner hanger 15 is to be set, and/or downhole conditions such as temperature or pressure.

The running tool 10 may include tool downhole electronics 13 for processing received acoustic signals and controlling a running tool component. The downhole electronics 13 may also process sensed data and transmit that data to the surface as an acoustic signal. Similarly, the liner hanger 15 may include liner hanger downhole electronics 18 for processing received acoustic signals to control a liner hanger component and may process sensed data to transmit that data to the surface as an acoustic signal.

Figure 2A:
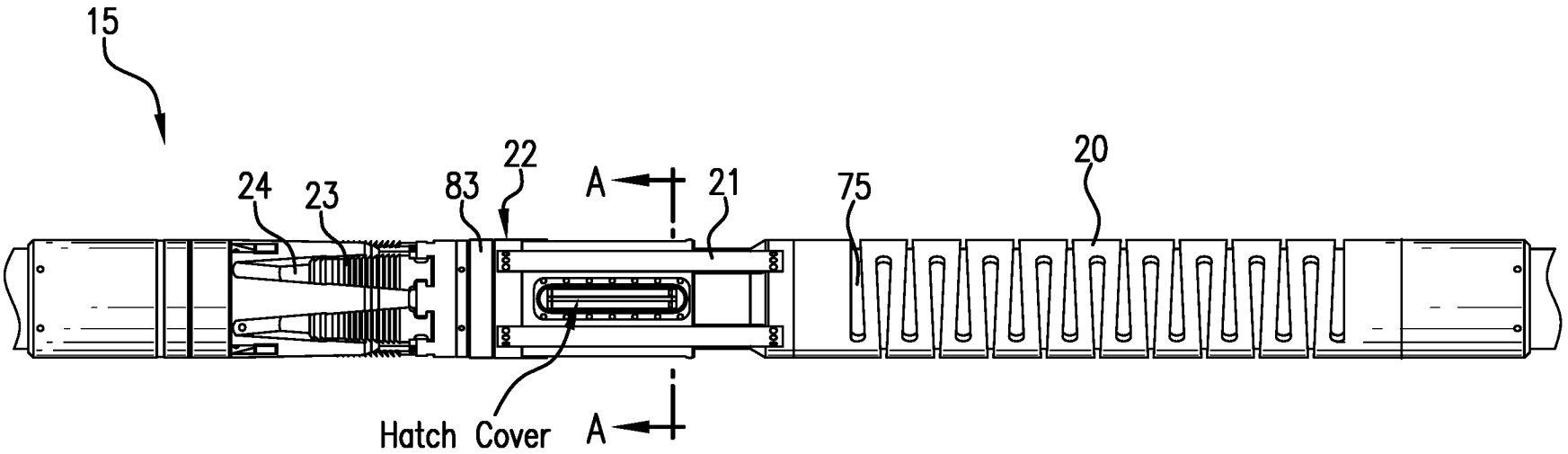
FIGS. 2A-2C, collectively referred to as FIG. 2, depict aspects of the liner hanger.

FIG. 2 depicts aspects of the liner hanger 15. Referring to FIG. 2A, the liner hanger 15 includes a hanger spring 20. The hanger spring 20 is in a compressed state prior to the liner hanger 15 being set at a selected location in the borehole 2. Non-limiting embodiments of the hanger spring 20 include a coil spring and a wave spring. In one or more embodiments, the hanger spring 20 is a single spring that may surround a body 75 of the liner hanger 15. The hanger spring 20 is connected to a load bar 21 that transmits spring force to a release mechanism 22. The hanger release mechanism 22 is configured to hold back the force of the spring until upon activation the hanger release mechanism 22 releases the force. Upon release of the spring force, the spring force acts on a bearing 83, which in turn causes a slip 23 to move and ride up an inclined-shaped slip seat 24. Riding up the slip seat 24 causes the slip 23 to engage and press against the casing 5 thus securing the liner hanger 15 and the associated liner in the borehole 2.

Figure 2B:
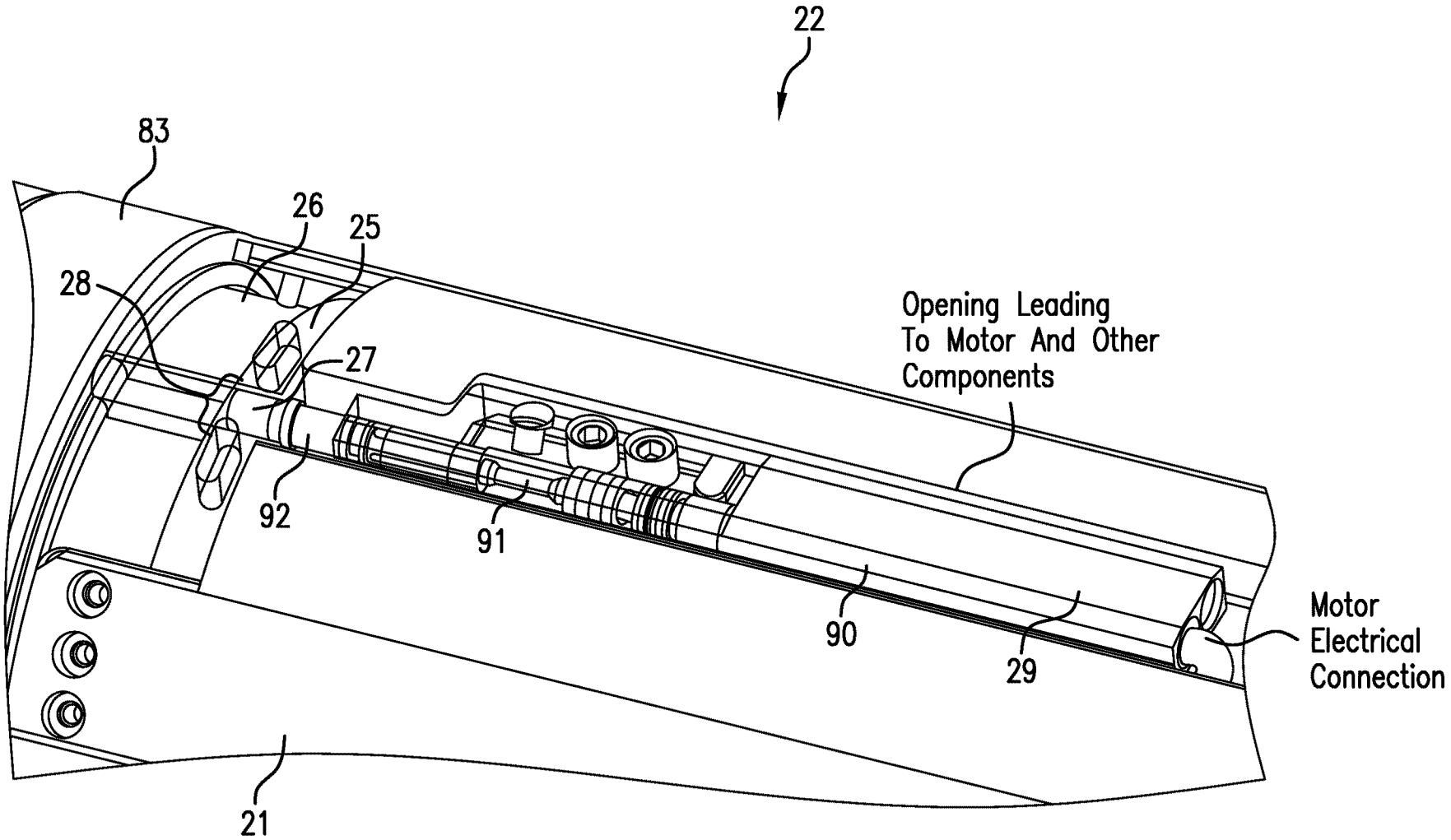

FIG. 2B depicts aspects of the hanger release mechanism 22. The hanger release mechanism 22 includes a C-ring 25 surrounded by a C-ring sleeve 26. A pin 27 inserted in a gap 28 of the C-ring 25 keeps the C-ring 25 expanded and in contact with C-ring sleeve 26 thus locking the C-ring sleeve 26 in place and holding back the spring force. The inside of the C-ring sleeve 26 may have jagged grooves that engage the C-ring 25 to hold the C-ring sleeve 26 in place with the C-ring 25 in the expanded state as shown. In general, the C-ring may be referred to as a spring force retention device and the pin as a gap member. The term "gap member" is used to encompass all devices configured for being inserted into the gap and being withdrawn from the gap.

A similar but alternative arrangement can use a C-Ring that is restrained in tension around a groove in the body 75. The pin 27 can be reconfigured to connect to the cut ends of the C-Ring so that it can hold tension, forming a continuous tensile element with the C-Ring. In other words, the C-ring that restrains the spring could be made to expand into the C-ring sleeve rather than collapse onto the hanger body when the pin is removed.

An electric motor 29 is disposed in a pressure-compensated housing 90. The motor 29 is mechanically coupled to a lead screw 91 and controlled by the downhole electronics 13. The lead screw 91 has screw threads that engage screw threads in a pin adapter 92 that is coupled to the pin 27 such that rotation of the lead screw 91 by the motor 29 in a certain rotational direction upon receipt of the acoustic activation signal causes the pin 27 to retract from the gap 28. Once the pin 27 is fully retracted from the gap 28, the C-ring 25 collapses and releases the C-ring sleeve 26 from engagement thus causing the load bar 21 to transfer the spring force to the bearing 83 causing the bearing 83 to move.

Other force generating designs can be substituted for the lead screw 91 and/or the electric motor 29, such as devices using thermal expansion, pressure-generating chemical reactions, mechanical potential energy, hydraulic pumps, hydraulic motors and solenoids. The term "force generator" is used to encompass various types of devices configured for applying a force to withdraw the pin or gap member from the gap.

Figure 2C:
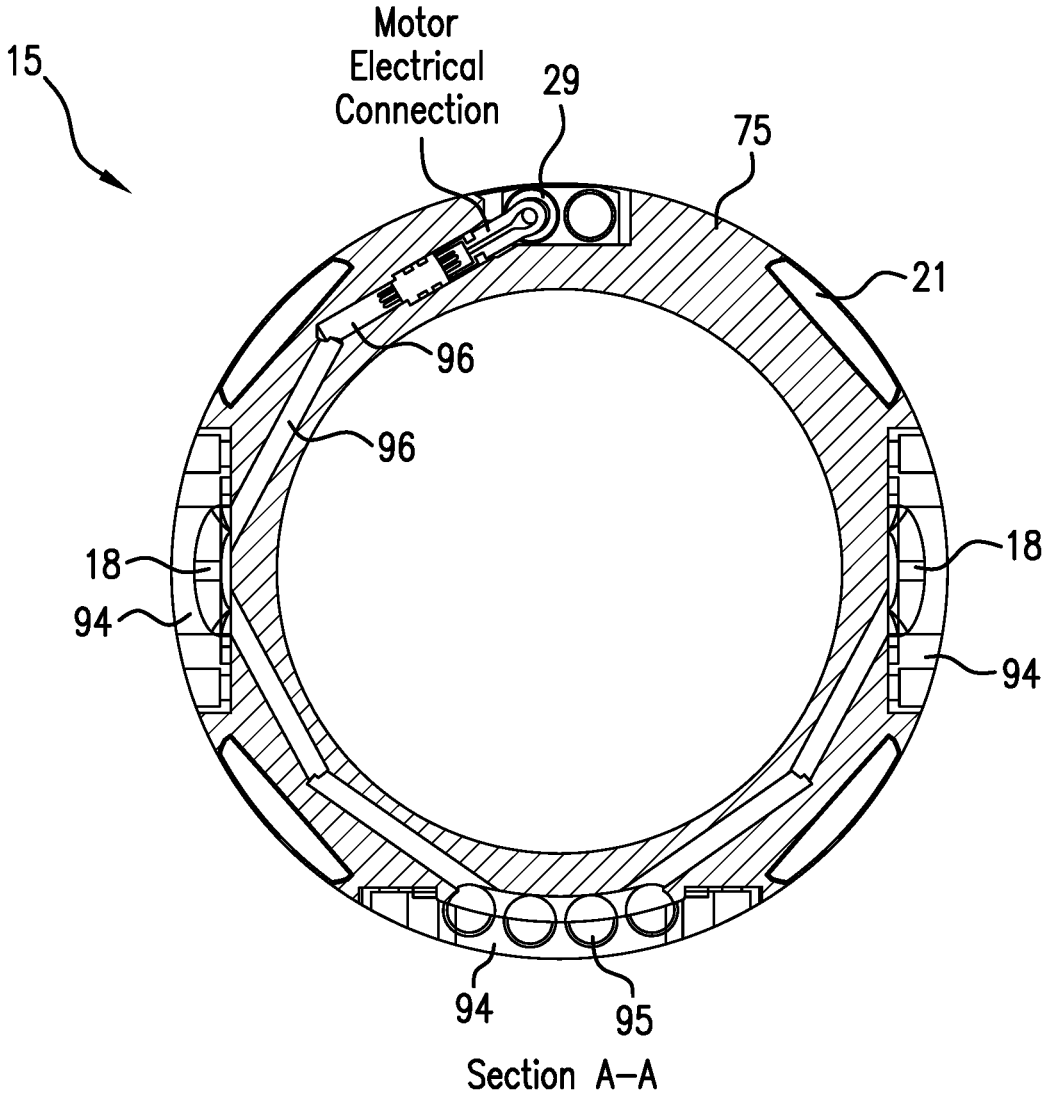

FIG. 2C depicts aspects of the liner hanger 15 in an axial cross-sectional view. The liner hanger 15 includes the body 75 having a plurality of pockets 94 for housing various components such as the downhole electronics 13 and batteries 95 for powering the downhole electronics 13 and the motor 29. In addition, the body 75 may includes various channels 96 for housing wires connecting the various electrical and electronic components.

FIG. 3 depicts aspects of the running tool 10. Referring to FIG. 3A, the running tool 10 is releasably connected to an extension sleeve 30. The extension sleeve 30 connects the running tool 10 to the liner hanger 15. The liner hanger 15 may be one of several tools coupled together in a string that is coupled to the extension sleeve 30. The running tool 10 includes an engagement element or collet 31 that engages a slot or groove 32 in the inner diameter of the extension sleeve 30. The collet 31 and/or the groove 32 have a slanted edge for engaging the collet 31 in the groove 32. With the collet 31 engaged in the groove 32, the collet 31 supports the entire weight of the extension sleeve 30 and the string of tools and the liner connected to it. In one or more embodiments, the collet 31 includes a plurality of collets 31 distributed about the inner circumference of the extension sleeve 30 in order to distribute the weight of the string among the collets.

The running tool 10 includes a tool spring 34 and a tool release mechanism 33, similar to the hanger release mechanism 22, which can release a force of the tool spring 34. Non-limiting embodiments of the tool spring 34 include a coil spring, a single spring, a wave spring, and a stack of spring washers. With the tool spring 34 locked in the compressed state, the collet 31 remains in place in the groove 32. The tool spring 34 is locked in the compressed state by a C-ring sleeve 35. On the uphole side of the collet 31, one end of that side engages with C-ring sleeve 35 while the other end of that side engages the tool spring 34. That is, the uphole side of the collet 31 is sandwiched between the C-ring sleeve 35 and the tool spring 34. A C-ring 36 in an expanded state engages the C-ring sleeve 35 to prevent the C-ring sleeve 35 from moving. A pin 37 inserted into the gap in the C-ring 36 keeps the C-ring 36 in the expanded state. Hence, with the C-ring 36 in the expanded state, the downhole side of the collet 31 remains engaged into the groove 32 and the extension sleeve 30 remains connected to the running tool 10.

Figure 3A:
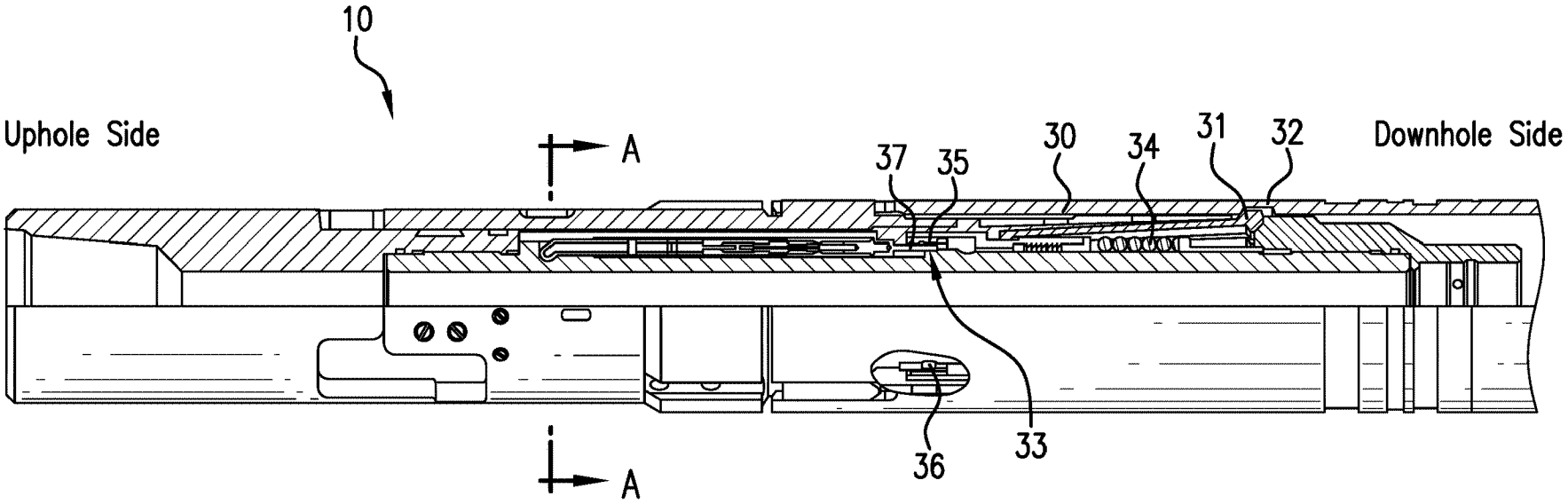
FIGS. 3A-3D, collectively referred to as FIG. 3, depict aspects of a running tool.
Figure 3B:
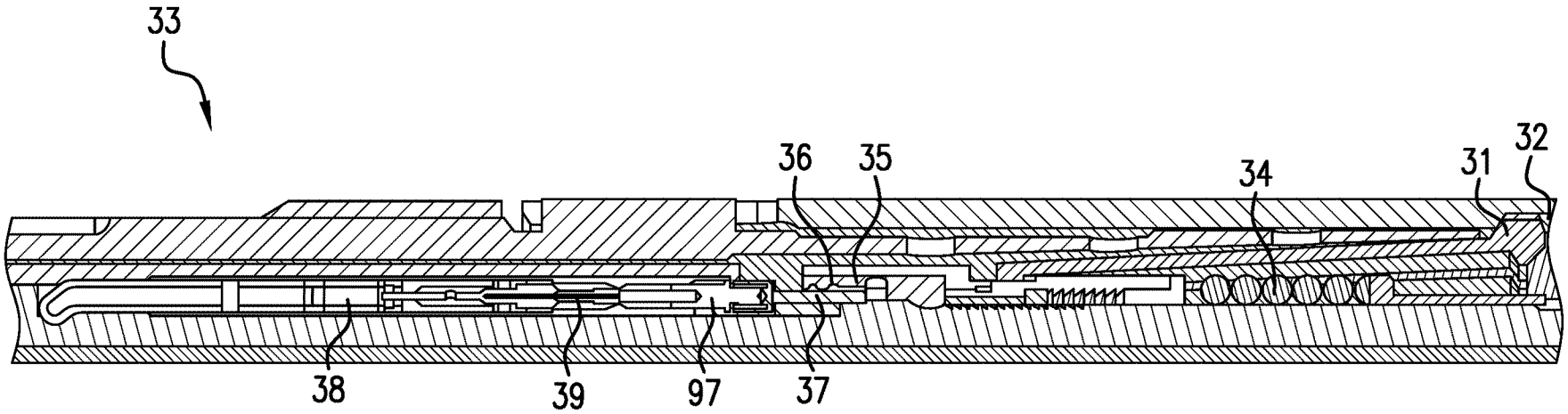
Figure 3C:
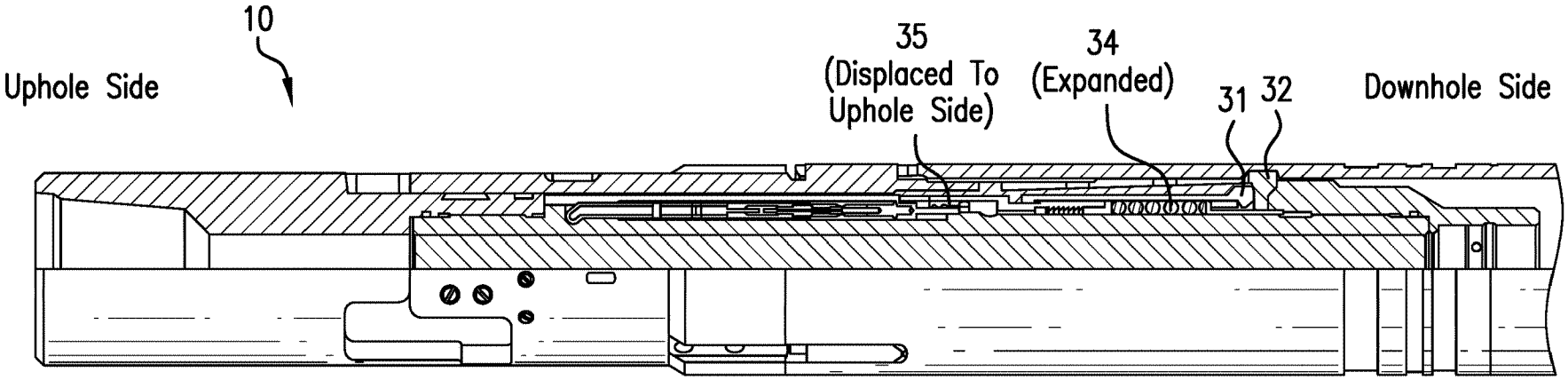

As with the liner hanger 15, the running tool 10 includes a motor 38 connected to a lead screw 39 as illustrated in FIG. 3B. The lead screw 39 has threads that engage threads of a lead nut 97 that is attached to the pin 37. Thus, as the motor 38 rotates in a certain direction upon receipt of the acoustic activation signal, the lead screw 39 also rotates and moves the lead nut 97 and the attached pin 37 closer towards the motor 38 thereby withdrawing the pin 37 from the gap. With the pin 37 withdrawn from the gap, the C-ring 36 collapses and no longer engages the C-ring sleeve 35. With the C-ring sleeve 35 free to move, the tool spring 34 applies a spring force on the uphole side of the collet 31 causing the collet 31 to move axially in the uphole direction in the extension sleeve 30 as illustrated in FIG. 3C. Axial uphole movement of the collet 31 causes the downhole side of the collet 31 to disengage from the groove 32 due to the slanted edges of the downhole side of the collet 32 and/or the groove 32. With the collet 31 disengaged from the groove 32, the running tool 10 is disconnected from the extension sleeve 30 and thus the liner hanger 15. In certain embodiments, the running tool 10 (and the liner hanger 15) may include intervening components for transmitting the spring force such as between the tool spring 34 and the C-ring sleeve 35 for example.

Figure 3D:
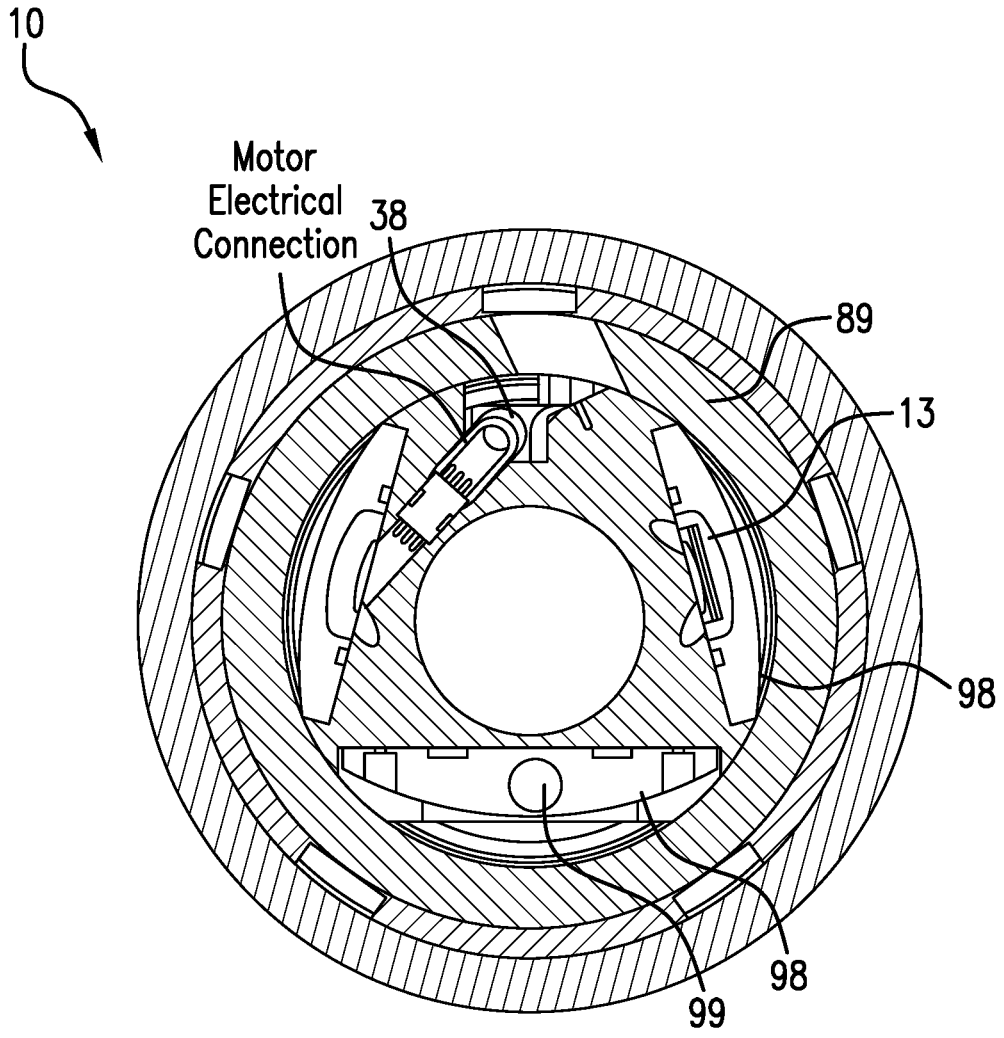

FIG. 3D depicts aspects of the running tool 10 in a cross-sectional axial view. Similar to the liner hanger 15, the running tool 10 includes a body 89 having pockets 98 to house the motor 38, the downhole electronics 13, batteries 99 for powering the downhole electronics 18 and the motor 38, and optionally the tool sensor 12. In addition, the body 89 includes various channels 88 for housing wires connecting the various electrical and electronic components.

Figure 4:
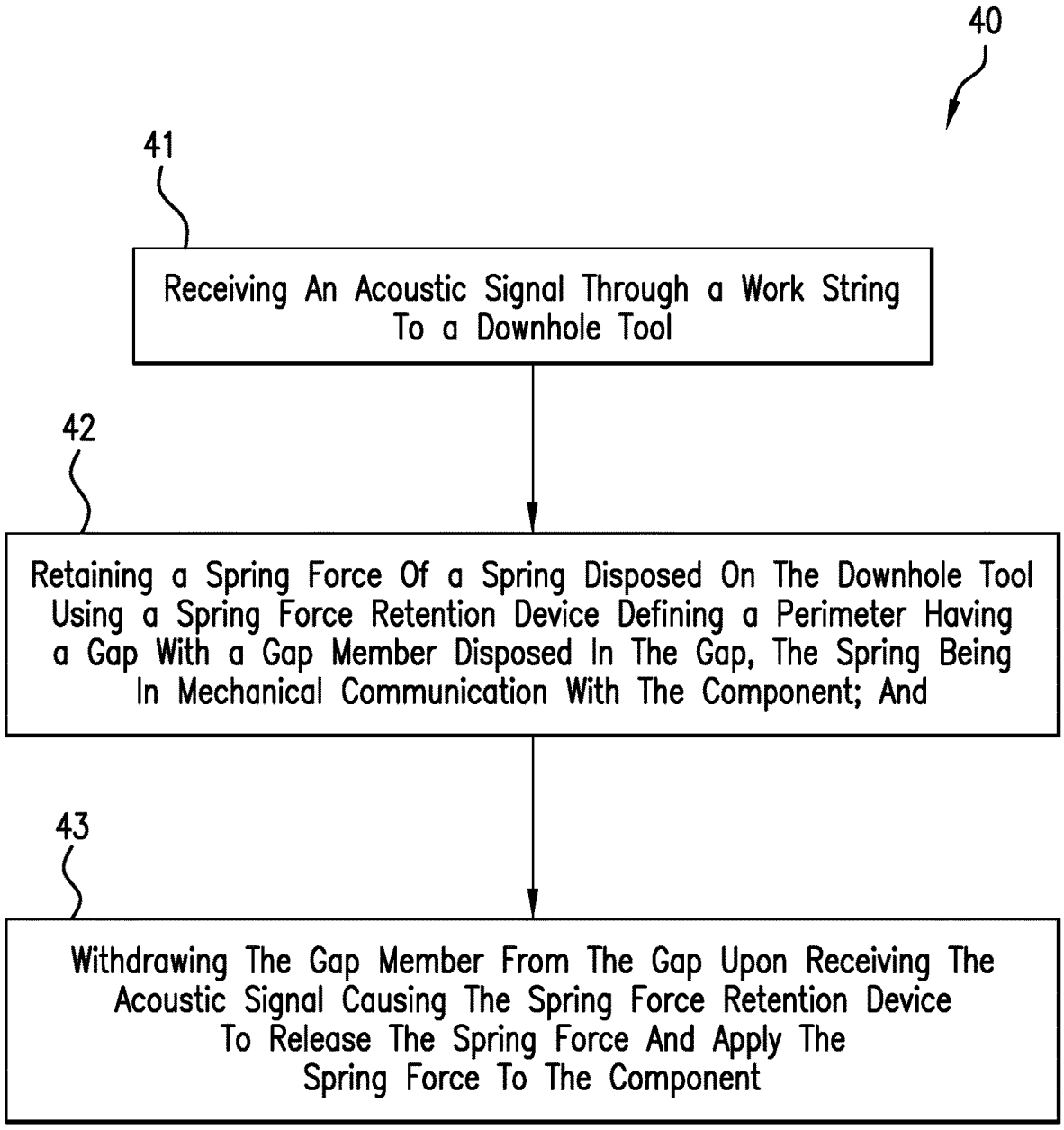
FIG. 4 is a flow chart for a method for installing a liner hanger in the borehole.

FIG. 4 is a flow chart for a method 40 for applying a force to a component in a borehole penetrating a subsurface formation. Block 41 calls for receiving an acoustic signal through a work string to the downhole tool. Block 42 calls for retaining a spring force of a spring disposed on the downhole tool using a spring force retention device defining a perimeter having a gap with a gap member disposed in the gap, the spring being in mechanical communication with the component. Block 43 calls for withdrawing the gap member from the gap upon receiving the acoustic signal causing the spring force retention device to release the spring force and apply the spring force to the component. The spring force retention device may be in a state of compression or a state of tension with the gap member installed in the gap. In one or more embodiments, withdrawing the gap member includes rotating a threaded lead screw with a motor, the threaded lead screw being in mechanical communication with the gap member.

The method 40 may also include sensing a characteristic of the downhole tool using a sensor disposed on the downhole tool and transmitting an uplink acoustic signal comprising sensed data to the surface. In one or more embodiments, the characteristic of the downhole tool includes a health of the downhole tool and/or a status of the downhole tool such as the spring force being released or in retention.

The disclosure herein provides several advantages. One advantage is that the use of acoustic activation signals enables precise control of activation of the liner hanger and the running tool. In addition, the use of the sensors provides confirmation that the liner hanger or running tool has actually been activated. Another advantage is that the use of a spring in the liner hanger and the running tool eliminates the need for a hydraulic cylinder with the associated strength and pressure limitations. Yet another advantage is that activation of the liner hanger and running tool using an acoustic signal eliminates the need for a ball drop mechanism where the ball may not seal correctly or the ball will not allow continuous fluid flow, which increases the risk of obstructions.

Set forth below are some embodiments of the foregoing disclosure:

Embodiment 1: A downhole tool for applying a force to a component in a borehole penetrating a subsurface formation, the downhole tool comprising an acoustic transducer configured to receive an acoustic signal, a spring having a spring force, a spring force retention device defining a perimeter having a gap and in mechanical communication with the component, the spring force retention device being configured to retain the spring force, a gap member configured to be disposed in the gap; and a force generator coupled to the gap member and in operable communication with the acoustic receiver and configured to operate in response to receiving the acoustic signal to withdraw the gap member from the gap to cause the spring force retention device to release the spring force thereby applying the spring force to the component.

Embodiment 2: The downhole tool as in any prior embodiment wherein the force generator is an electric motor.

Embodiment 3: The downhole tool as in any prior embodiment wherein the downhole tool is liner hanger configured to be set in the borehole.

Embodiment 4: The downhole tool as in any prior embodiment wherein the component is a slip.

Embodiment 5: The downhole tool as in any prior embodiment wherein the downhole tool is a running tool configured to convey a device of interest to a selected location in the borehole and release the device at the selected location.

Embodiment 6: The downhole tool as in any prior embodiment wherein the device of interest is a liner hanger.

Embodiment 7: The downhole tool as in any prior embodiment wherein the component is a collet in mechanical communication with the liner hanger.

Embodiment 8: The downhole tool as in any prior embodiment wherein an end of the collet is disposed in a groove of an extension sleeve coupled to the liner hanger.

Embodiment 9: The downhole tool as in any prior embodiment wherein the spring force retention device is a C-ring having a normal state and an expanded state and the gap member is a pin configured to be inserted in the gap with the C-ring in the expanded state.

Embodiment 10: The downhole tool as in any prior embodiment further comprising a threaded adapter coupled to the pin and a lead screw coupled to the motor at one end and to the adapter at the other end such that operation of the motor rotates the lead screw to withdraw the pin from the gap causing the C-ring to be in the normal state.

Embodiment 11: The downhole tool as in any prior embodiment further comprising a C-ring sleeve with an inside diameter such that the C-ring sleeve engages the C-ring with the C-ring in the expanded state and disengages from the C-ring with the C-ring in the normal state.

Embodiment 12: The downhole tool as in any prior embodiment further comprising a sensor that provides sensor data.

Embodiment 13: The downhole tool as in any prior embodiment wherein the acoustic transducer is configured to transmit the sensor data as an uplink acoustic signal to a surface acoustic transducer in communication with a controller comprising a user interface to receive user input for transmission by the surface acoustic transducer and/or display received data received by the surface acoustic transducer.

Embodiment 14: The downhole tool as in any prior embodiment wherein the sensor is configured to sense a characteristic of a component indicating a status of the downhole tool, the sensor being in communication with the downhole electronics for transmitting sensed data to the surface acoustic transducer.

Embodiment 15: The downhole tool as in any prior embodiment wherein the sensor is a position sensor.

Embodiment 16: The downhole tool as in any prior embodiment wherein the spring force retention device is in one of a state of compression and a state of tension with the gap member installed in the gap.

Embodiment 17: A method for applying a force to a component in a downhole tool disposed in a borehole penetrating a subsurface formation, the method comprising receiving an acoustic signal through a work string to the downhole tool, retaining a spring force of a spring disposed on the downhole tool using a spring force retention device defining a perimeter having a gap with a gap member disposed in the gap, the spring being in mechanical communication with the component; and withdrawing the gap member from the gap upon receiving the acoustic signal causing the spring force retention device to release the spring force and apply the spring force to the component.

Embodiment 18: The method as in any prior embodiment wherein withdrawing the gap member comprises rotating a threaded lead screw with a motor, the threaded lead screw being in mechanical communication with the gap member.

Embodiment 19: The method as in any prior embodiment further comprising sensing a characteristic of the downhole tool using a sensor disposed on the downhole tool and transmitting an acoustic signal comprising sensed data to the surface.

Embodiment 20: The method as in any prior embodiment wherein the downhole tool comprises a liner hanger and/or a running tool.

In support of the teachings herein, various analysis components may be used, including a digital and/or an analog system. For example, the controller 8, the tool downhole electronics 13, the hanger liner downhole electronics 18, the tool sensor 12, and/or the liner hanger sensor 17 may include digital and/or analog systems. The system may have components such as a processor, storage media, memory, input, output, communications link (wired, wireless, optical or other), user interfaces (e.g., a display or printer), software programs, signal processors (digital or analog) and other such components (such as resistors, capacitors, inductors and others) to provide for operation and analyses of the apparatus and methods disclosed herein in any of several manners well-appreciated in the art. It is considered that these teachings may be, but need not be, implemented in conjunction with a set of computer executable instructions stored on a non-transitory computer readable medium, including memory (ROMs, RAMs), optical (CD-ROMs), or magnetic (disks, hard drives), or any other type that when executed causes a computer to implement the method of the present invention. These instructions may provide for equipment operation, control, data collection and analysis and other functions deemed relevant by a system designer, owner, user or other such personnel, in addition to the functions described in this disclosure.

Further, various other components may be included and called upon for providing for aspects of the teachings herein. For example, a power supply, magnet, electromagnet, sensor, electrode, transmitter, receiver, transceiver, antenna, controller, optical unit or components, electrical unit or electromechanical unit may be included in support of the various aspects discussed herein or in support of other functions beyond this disclosure.

Elements of the embodiments have been introduced with either the articles "a" or "an." The articles are intended to mean that there are one or more of the elements. The terms "including" and "having" and the like are intended to be inclusive such that there may be additional elements other than the elements listed. The conjunction "or" when used with a list of at least two terms is intended to mean any term or combination of terms. The term "configured" relates one or more structural limitations of a device that are required for the device to perform the function or operation for which the device is configured. The terms "first" and "second" are not intended to denote a particular order but rather to distinguish elements.

The flow diagram depicted herein is just an example. There may be many variations to this diagram or the steps (or operations) described therein without departing from the scope of the invention. For example, operations may be performed in another order or other operations may be performed at certain points without changing the specific disclosed sequence of operations with respect to each other. All of these variations are considered a part of the claimed invention.

The disclosure illustratively disclosed herein may be practiced in the absence of any element which is not specifically disclosed herein.

While one or more embodiments have been shown and described, modifications and substitutions may be made thereto without departing from the scope of the invention. Accordingly, it is to be understood that the present invention has been described by way of illustrations and not limitation.

It will be recognized that the various components or technologies may provide certain necessary or beneficial functionality or features. Accordingly, these functions and features as may be needed in support of the appended claims and variations thereof, are recognized as being inherently included as a part of the teachings herein and a part of the invention disclosed.

While the invention has been described with reference to exemplary embodiments, it will be understood that various changes may be made and equivalents may be substituted for elements thereof without departing from the scope of the invention. In addition, many modifications will be appreciated to adapt a particular instrument, situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the appended claims.

What is claimed is:

1. A downhole tool for applying a force to a component in a borehole penetrating a subsurface formation, the downhole tool comprising:

an acoustic transducer configured to receive an acoustic signal;

a spring having a spring force;

a spring force retention device defining a perimeter having a gap in the perimeter and being in mechanical communication with the component, the spring force retention device being configured to retain the spring force;

a gap member configured to be disposed in the gap; and a force generator comprising an interface that is coupled to the gap member, the force generator being in operable communication with the acoustic transducer and configured to operate in response to receiving the acoustic signal to withdraw the gap member from the gap to cause the spring force retention device to release the spring force thereby applying the spring force to the component.

2. The downhole tool according to claim 1, wherein the force generator is an electric motor.

3. The downhole tool according to claim 1, wherein the downhole tool is a liner hanger configured to be set in the borehole.

4. The downhole tool according to claim 3, wherein the component is a slip.

5. The downhole tool according to claim 1, wherein the downhole tool is a running tool configured to convey a device of interest to a selected location in the borehole and release the device at the selected location.

6. The downhole tool according to claim 5, wherein the device of interest is a liner hanger.

7. The downhole tool according to claim 6, wherein the component is a collet in mechanical communication with the liner hanger.

8. The downhole tool according to claim 7, wherein an end of the collet is disposed in a groove of an extension sleeve coupled to the liner hanger.

9. The downhole tool according to claim 1, wherein the spring force retention device is a C-ring having a normal state and an expanded state and the gap member is a pin configured to be inserted in the gap with the C-ring in the expanded state.

10. The downhole tool according to claim 9, further comprising a threaded adapter coupled to the pin and a lead screw coupled to a motor at one end and to the threaded adapter at the other end such that operation of the motor rotates the lead screw to withdraw the pin from the gap causing the C-ring to be in the normal state.

11. The downhole tool according to claim 9, further comprising a C-ring sleeve with an inside diameter such that the C-ring sleeve engages the C-ring with the C-ring in the expanded state and disengages from the C-ring with the C-ring in the normal state.

12. The downhole tool according to claim 1, further comprising a sensor that provides sensor data.

13. The downhole tool according to claim 12, wherein the acoustic transducer is configured to transmit the sensor data as an uplink acoustic signal to a surface acoustic transducer in communication with a controller comprising a user interface to receive user input for transmission by the surface acoustic transducer and/or display received data received by the surface acoustic transducer.

14. The downhole tool according to claim 12, wherein the sensor is configured to sense at least one of (i) a characteristic of the component indicating a status of the downhole tool or (ii) an operational aspect of the downhole tool, the sensor being in communication with downhole electronics for transmitting sensed data to the surface acoustic transducer.

15. The downhole tool according to claim 14, wherein the sensor is a position sensor.

16. The downhole tool according to claim 1, wherein the spring force retention device is in one of a state of compression and a state of tension with the gap member installed in the gap.

17. A method for applying a force to a component in a downhole tool disposed in a borehole penetrating a subsurface formation, the method comprising:

receiving an acoustic signal through a work string to the downhole tool;

retaining a spring force of a spring disposed on the downhole tool using a spring force retention device defining a perimeter having a gap in the perimeter with a gap member disposed in the gap, the spring being in mechanical communication with the component; and withdrawing the gap member from the gap upon receiving the acoustic signal causing the spring force retention device to release the spring force and apply the spring force to the component.

18. The method according to claim 17, wherein withdrawing the gap member comprises rotating a threaded lead screw with a motor, the threaded lead screw being in mechanical communication with the gap member.

19. The method according to claim 17, further comprising sensing a characteristic of the downhole tool using a sensor disposed on the downhole tool and transmitting an acoustic signal comprising sensed data to the surface.

20. The method according to claim 17, wherein the downhole tool comprises a liner hanger and/or a running tool.

* * * * *